US011274910B2

(12) United States Patent
Schut et al.

(10) Patent No.: US 11,274,910 B2
(45) Date of Patent: Mar. 15, 2022

(54) DART HOLDER PROVIDING A GRIP POSITION ON A DART

(71) Applicant: J&J Idee B.V., Arnhem (NL)

(72) Inventors: Jans Schut, Arnhem (NL); Jeroen Bart Peters, Arnhem (NL)

(73) Assignee: J&J Idee B.V., Arnhem (NL)

( * ) Notice: Subject to any disclaimer, the term of this patent is extended or adjusted under 35 U.S.C. 154(b) by 466 days.

(21) Appl. No.: 16/326,501

(22) PCT Filed: Aug. 30, 2017

(86) PCT No.: PCT/NL2017/050574

§ 371 (c)(1),
(2) Date: Feb. 19, 2019

(87) PCT Pub. No.: WO2018/044166

PCT Pub. Date: Mar. 8, 2018

(65) Prior Publication Data

US 2021/0223016 A1 Jul. 22, 2021

(30) Foreign Application Priority Data

Aug. 31, 2016 (EP) ..... 16186704
Jul. 6, 2017 (NL) ..... 2019195

(51) Int. Cl.
*F42B 39/00* (2006.01)
*A47B 81/00* (2006.01)
*F42B 6/00* (2006.01)

(52) U.S. Cl.
CPC ..... *F42B 39/007* (2013.01); *A47B 81/00* (2013.01); *F42B 6/003* (2013.01)

(58) Field of Classification Search
CPC ..... F42B 39/007; F42B 6/003; A47B 81/00; F41B 5/06
See application file for complete search history.

(56) References Cited

U.S. PATENT DOCUMENTS 1,649,245 A * 11/1927 McGraw ..... A63B 57/0032 206/102
3,476,257 A * 11/1969 O'Connell ..... B60R 7/08 211/13.1

(Continued)

FOREIGN PATENT DOCUMENTS

DE 298 05 568 U1 8/1998
DE 29913872 U1 * 11/1999 ..... F42B 39/007

(Continued)

*Primary Examiner* — Stanton L Krycinski
(74) *Attorney, Agent, or Firm* — Shewchuk IP Services, LLC; Jeffrey D. Shewchuk

(57) ABSTRACT

A dart holder (10) comprising:

first positioning means (1), holding means (3) for holding optionally at least the tip and/or part of the barrel of a dart in a settled position in the first positioning means (1) such that the barrel of said dart is accessible for being grabbed by a user's hand, a first landing area (4) arranged on the first positioning means (1) in respect to the holding means (3) such that said first landing area (4) provides a reference to at least part of the hand for grabbing the barrel at a target position, wherein the holding means (3) is formed by a shaft (30) extending from the first landing area (4) at least partially through the first positioning means (1) up to a shaft end (31) facing away from the first landing area (4), wherein the shaft (30) is provided with a limitation reference means (8) to define a limitation for the tip of the barrel when it is inserted in the shaft (30).

17 Claims, 6 Drawing Sheets

(56) References Cited

U.S. PATENT DOCUMENTS 3,796,454 A * 3/1974 Williamson ..... A47J 43/283 294/7
3,866,992 A * 2/1975 Katz ..... B43M 99/007 211/69.5
3,960,271 A * 6/1976 Nelson ..... F42B 6/003 206/315.1
4,030,599 A * 6/1977 Bruni ..... B25H 3/003 206/379
4,105,119 A * 8/1978 Cowan ..... F41J 3/0028 206/579
4,253,830 A * 3/1981 Kazen ..... A61C 3/04 206/368
4,257,613 A * 3/1981 Meyer Thor Straten ..... F42B 6/003 473/574
4,294,365 A 10/1981 Henderson
D262,465 S * 12/1981 Henderson ..... D21/385
4,387,805 A * 6/1983 Lanius ..... F41B 5/14 206/230
4,397,395 A * 8/1983 McKelvey ..... B25H 3/003 206/369
D290,672 S * 7/1987 Pearson ..... D6/552
4,773,578 A * 9/1988 Braun ..... A45F 5/00 206/315.1
4,850,484 A * 7/1989 Denman ..... A61M 5/008 206/366
D308,783 S * 6/1990 Pearson ..... D6/552
5,033,629 A * 7/1991 Caine ..... B43M 99/007 211/69.5
5,067,610 A * 11/1991 Jensen ..... B65D 85/00 206/315.1
5,127,210 A * 7/1992 Jensen ..... B65D 85/00 53/467
5,190,169 A * 3/1993 Sincock ..... A61M 5/3213 206/366
5,314,413 A * 5/1994 McCowan ..... B01L 9/06 211/78
5,624,404 A * 4/1997 Fisler ..... B01L 9/06 211/74
5,641,079 A * 6/1997 Schmidt ..... A47F 5/0823 211/104
5,823,363 A * 10/1998 Cassel ..... A61M 5/3213 211/60.1
5,850,917 A * 12/1998 Denton ..... A61M 5/008 206/366
6,202,862 B1 * 3/2001 Acquaviva ..... B43K 21/003 211/60.1
6,595,655 B2 * 7/2003 Neeb ..... F41B 5/06 206/315.1
6,955,259 B1 * 10/2005 Jesse ..... A61M 5/008 206/366
6,997,334 B2 * 2/2006 Manix ..... A45C 11/00 206/380
7,314,142 B2 * 1/2008 Lyman, Jr. ..... B43K 23/002 206/214
7,419,320 B2 * 9/2008 LaBrasca ..... A45C 11/34 206/1.7
7,611,012 B2 * 11/2009 Ross ..... A61M 5/008 206/366
8,348,067 B2 * 1/2013 Brown ..... A47F 7/0028 211/60.1
8,789,713 B2 * 7/2014 Koller ..... A61B 50/20 211/85.13

FOREIGN PATENT DOCUMENTS

DE 19849478 A1 * 5/2000 ..... F42B 39/007
DE 200 08 166 U1 9/2001
GB 537 638 A 6/1941
GB 575832 A * 3/1946 ..... F42B 6/003
GB 620380 A * 3/1949 ..... F42B 39/007
GB 650068 A * 2/1951 ..... F41B 5/06
GB 1342597 A * 1/1974 ..... B65D 85/24
GB 1541645 A * 3/1979 ..... F42B 39/007

* cited by examiner

DART HOLDER PROVIDING A GRIP POSITION ON A DART

FIELD OF THE INVENTION

The present invention relates to dart holders to be used by a person throwing darts in a game of darts.

BACKGROUND OF THE INVENTION

Darts is a form of throwing game in which small missiles (darts) are thrown at a dartboard. Many advances have been made in and for the various games of darts. Specific attention has been raised for the improvement of specific parts of the darts. The barrel, shaft and flight all have an impact on the consistency of throwing. The choice of the barrel, shaft and flight depends for a great deal on individual preferences and throwing style. The location of the grip on the barrel of the dart can have an effect on the flight path and stability of the dart. Therefore darts players spend many hours practicing finding the right grip position on the dart. To help find the best grip position many adjustments to the barrel have been made. Some barrels comprise carved out patterns to improve the grip while others comprise shapes such as dish-outs to enhance finding the best finger placement on the dart. Although these patterns and shapes on the barrel of the dart provide a guidance for finding the right grip position there is still room for improvement.

It is an object of the invention to provide improved guidance for finding the right grip position on the barrel of the dart.

SUMMARY OF THE INVENTION

To this end, the invention relates to a dart holder comprising:

first positioning means, holding means for holding optionally at least the tip and/or part of the barrel of a dart in a settled position in the first positioning means such that the barrel of said dart is accessible for being grabbed by a user's hand, a first landing area arranged on the first positioning means in respect to the holding means such that said first landing area provides a reference to at least part of the hand for grabbing the barrel at a target position, wherein the holding means is formed by a shaft extending from the first landing area at least partially through the first positioning means up to a shaft end facing away from the first landing area, wherein the shaft is provided with a limitation reference means to define a limitation for the tip of the barrel when it is inserted in the shaft.

DETAILED DESCRIPTION OF THE INVENTION

The invention concerns a dart holder according to claim 1. The dart holder according to the invention provides a reference to at least partly prevent a dart player from randomly grabbing the dart at any position on the barrel thus achieving higher accuracy in throwing the dart. The shaft allowing the dart to travel into the positioning means, is provided with a limitation reference means to restrict the tip of the dart from travelling beyond the limitation reference means providing the dart may be inserted in a deepest position. When at least the tip and/or part of the barrel of a dart is inserted into the shaft, the deepest position of the dart is determined by the tip having arrived at the limitation reference means, the deepest position of the dart forming a reference point of the dart with respect to the first landing area of the first positioning means so as to allow the user to grab the dart according to a predetermined position known by the user.

In an embodiment, the limitation reference means is formed at the shaft end by an opening extending in the first positioning means, the shaft thereby forming a through hole. In this way, the deepest position of the dart may be detected by means of holding a finger of the user at the shaft end side of the first positioning means. When the user is sensing the tip of the dart at the opening extending in the first positioning means at the shaft end side of it, the dart has reached its deepest position and such that the barrel of said dart is accessible for being grabbed by the user's hand according to a predetermined position with respect to the first positioning means.

In an embodiment, the limitation reference means is formed by a stopper means. In this way, the deepest position of the dart is determined by the stopper means preventing the dart or the tip of the dart from being inserted in the shaft beyond the stopper means, such that the barrel of said dart is accessible for being grabbed by the user's hand according to a predetermined position with respect to the first positioning means.

In an embodiment, the stopper means is adjustable along the longitudinal direction of the shaft. In this way, the relative position of the dart with respect of the first positioning means may be adapted according to a dedicated position which is adapted and/or optimized for any specific user such that the barrel of said dart is accessible for being grabbed by said any user's hand.

In an embodiment, stopper adjustment means are arranged in the shaft of the first positioning means and the stopper means are arranged to cooperate with the stopper adjustment means so as to allow to position the stopper means relative to the shaft. In this way, the stopper adjustment means present in the shaft may be used to position the stopper means relative to the shaft so as to determine a position of the limitation reference means preventing or restricting the tip of the dart from travelling beyond the limitation reference means to cause a dedicated deepest position of the dart inserted in the shaft.

In an embodiment, the stopper adjustment means are formed by an array of staggered holes, each hole extending through the shaft along a centerline transverse to the longitudinal direction of the shaft, wherein the stopper means are formed by a pin capable of being arranged in at least one of the holes. In this way, the array of staggered holes provides any specific user to select a relative position of the dart with respect of the first positioning means which is a best fit for the specific user to grab the barrel at a preferred position of said any specific user.

In an embodiment, the stopper adjustment means are formed by a thread such as a screw thread, wherein the stopper means are means are formed by a bolt such as a screw bolt, the bolt being arranged to cooperate with the thread of the stopper adjustment means. In this way, the threaded hole provides any specific user to adjust and optimize a relative position of the dart with respect of the first positioning means according to a continuous variable adjustment, the adjusted and optimized relative position being a best fit for the specific user to grab the barrel at a preferred position of said any specific user.

In an embodiment, the dart holder comprises:

second positioning means connectable to the first positioning means;

a second landing area on the second positioning means arranged in respect to the holding means such that said first and second landing areas provide a reference to at least part of the hand for grabbing the barrel at a target position. The dart holder provides a reference to at least partly prevent a dart player from randomly grabbing the dart at any position on the barrel thus achieving higher accuracy in throwing the dart. Hereto the dart holder provides first and second positioning means that are connectable. The positioning means comprise holding means for holding the tip and/or part of the barrel of a dart in a settled position. In this way the tip and/or part of the barrel may be entered and withdrawn from the dart holder in a consistent and reproducible manner. When the tip of the dart is entered in the holding means, the barrel of the dart is accessible for being grabbed by a user's hand. The first positioning means comprise a first landing area and the second positioning means comprise a second landing area. In this way the landing areas provide a reference to at least part of the hand for grabbing the barrel of said dart at a target position when positioned in the holding means. Before grabbing the dart one or more fingers and/or part of the hand are placed on the landing area. In this way a reference for a grip position is provided.

In an embodiment the first landing area and the second landing area are staggered. In this way a reference for the fingers and/or part of the hand, that grabs the dart, is provided.

In an embodiment the first landing area and the second landing area are configured to prevent a hand and/or one or more fingers from moving further along the barrel towards or in the direction of the tip of the dart when located in the dart holder. To find the right position the user slides with his or her fingers along the barrel of the dart until the fingers and/or part of the hand touch the landing area. When the landing area is reached the fingers and/or part of the hand cannot move further and the right position to grab the barrel of the dart is reached.

In an embodiment a plane of the landing area is arranged relative to the holding means in such a way that it intersects the dart when located in the dart holder along the longitudinal axis of the barrel of the dart. In an embodiment, the landing area is made of a rigid and wear-resistant material. In this way, the landing area provides a reliable and reusable reference causing the barrel to be grabbed at a target position.

In an embodiment a plane of the landing area is arranged relative to the holding means in such a way that it intersects the dart when located in the dart holder along the longitudinal axis of the tip of the dart. Depending on the preference of the user to grab the barrel of the dart from the dart holder, the plane of the landing area may be at the level of the longitudinal axis of the barrel as described in the previous embodiment or at the level of the longitudinal axis of tip of the dart. The plane of the landing area provides a reliable reference causing the barrel to be grabbed at a target position.

In an embodiment the plane of the first landing area is located between the plane of the second landing area and the tip of the dart when located in the dart holder. This position will be preferred by players who keep their fingers in the same transversal direction as the axis of the barrel when in a throwing position. In this way, the first landing area can be used as a reference for a first finger of the user to position the first finger with reference to the barrel, and the second landing area can be used as a reference for a second finger of the user to position the second finger with reference to the barrel, providing an even more stable position of the hand with respect to the barrel of the dart to be grabbed in a same position.

In an embodiment the plane of the second landing area is located between the plane of the first landing area and the tip of the dart when located in the dart holder. This position will be preferred by players who hold the dart in a pencil hold grip. In this way the first landing area is used as a reference for placing the hand and/or one or more fingers while the dart is placed in the holding means of the second positioning means.

In an embodiment the distance between the first and second landing area is adjustable. In this way, the position of the first landing area and the position of the second landing area relative to the at least part of the hand and/or finger of a user is adjustable so that each user can install and set the second landing area relative to the first landing area according to his favourite position.

In an embodiment the dart holder comprises adjusting means for adjusting the plane of the landing area of the first and second positioning means. In this way, the first positioning means can be fixed to the second positioning means. The adjusting means may comprise but are not limited to for instance screws, bolts, slides, and springs. The landing area can be adjusted along the barrel of the dart when located in the dart holder relative to the holding means to adjust the position of the landing areas on the first and second positioning means relative to each other. In this way each individual user may adjust the distance between the first and second landing area according to his or her own preference to come to the best grip position.

In an embodiment the plane of the first landing area is flush with the plane of the second landing area to provide an extended landing area. In this way the dart holder can be adjusted for a person preferring an extended landing area.

In an embodiment the landing area has a concave shape which is substantially identical in shape with a finger of the user so as to allow a predefined grip on the dart based on the shape of the finger of the user. The concave shape provides a preformed fixed reference point for placing the finger before grabbing the barrel of the dart from the dart holder.

In an embodiment the landing area has a concave cavity wherein the opening of the holding means is placed in a position underneath the plane of the landing area. In this way a fixed reference position for grabbing the barrel of the dart when located in the holding means is provided. In other words, the landing area is provided with a concave cavity arranged in or protruding into the dart holder, in which cavity an opening is arranged for receiving the tip of the dart. In this way, the barrel end near the tip of the dart may touch the concave cavity working as a stopper element to prevent the dart from being inserted further through the opening to provide a fixed reference position for grabbing the barrel of the dart when located in the holding means.

In an embodiment the landing area has a convex shape wherein the opening of the holding means is placed in a position above the plane of the landing area. In this way a fixed reference position for grabbing the barrel of the dart when located in the holding means is provided. In other words, the landing area is provided with a convex shape arranged on or protruding from the dart holder, in which convex shape an opening is arranged for receiving the tip of the dart. In this way, the barrel end near the tip of the dart may touch the convex working as a stopper element to prevent the dart from being inserted further through the opening to provide a fixed reference position for grabbing the barrel of the dart when located in the holding means.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

It should be noted that items which have the same positioning numbers in different figures, have the same structural features and the same functions, or are the same signals. Where the function and/or structure of such item has been explained, there is no necessity for repeated explanation thereof in the detailed description.

DETAILED DESCRIPTION OF THE DRAWINGS

It should be noted that the above-mentioned embodiments illustrate rather than limit the invention, and that those skilled in the art will be able to design many alternative embodiments.

In the claims, any positioning signs placed between parentheses shall not be construed as limiting the claim. Use of the verb "comprise" and its conjugates does not exclude the presence of elements or steps other than those stated in a claim. The article "a" or "an" preceding an element does not exclude the presence of a plurality of such elements. In the dart holder claim enumerating several means, several of these means may be embodied by one and the same item of hardware. The mere fact that certain measures are recited in mutually different dependent claims does not indicate that a combination of these measures cannot be used to advantage.

Figure 1:
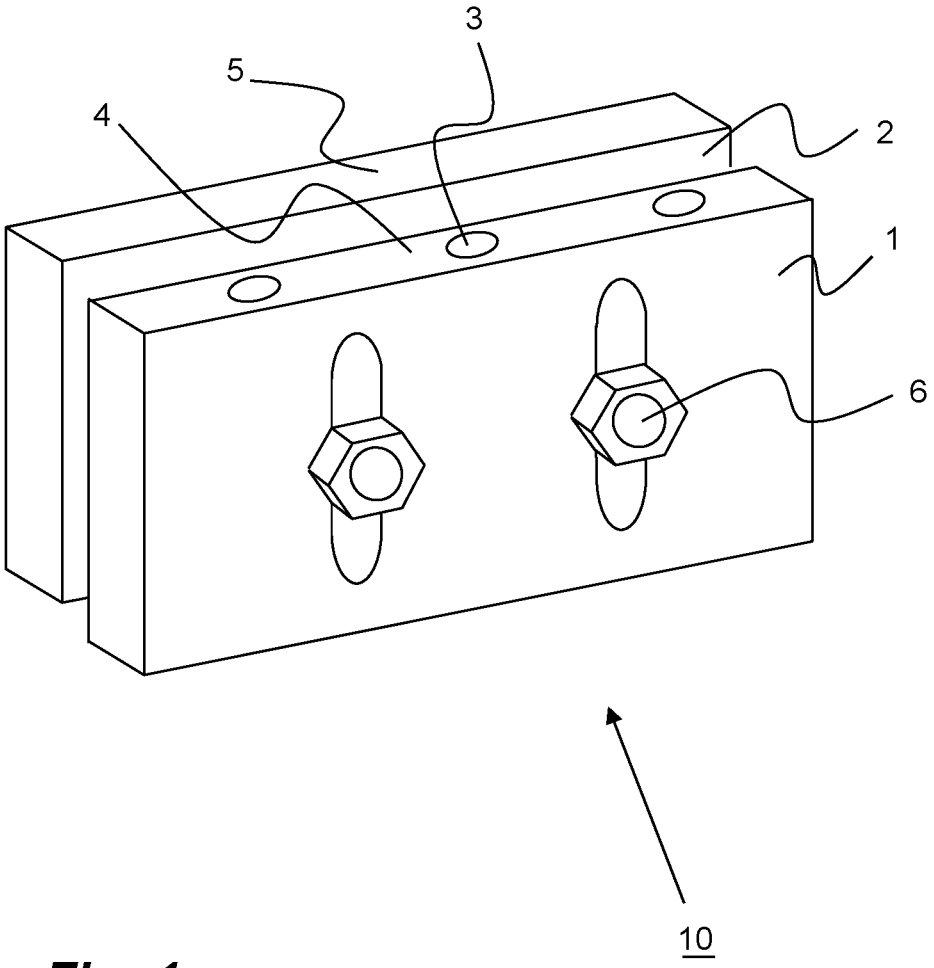
FIG. 1 is an isometric view of a dart holder.

FIG. 1 is an embodiment of the dart holder 10. The dart holder 10 containing first positioning means 1 and second positioning means 2. First positioning means 1 comprises holding means 3 to receive the tip of the dart in a single settled position. For a better grip or a more predefined position of the hand grabbing the dart, further positioning means for supporting further fingers or part of the hand may be arranged to the first and/or second positioning means.

Holding means 3 may extend into or along positioning means 1 so as to receive the tip and optionally at least part of the barrel of the dart. The holding means comprises an opening such as a hole, a slot, a notch, shaft, a ring or any other space extending into or along the dart holder to at least partially receive the tip and/or part of the barrel of the dart. First positioning means 1 is adjustably connected to second positioning means 2. First positioning means 1 comprises a first landing area 4 and second positioning means 2 comprises a second landing area 5. Any further positioning means likewise comprises a further landing area. The position of landing area 5 on positioning means 2 with respect to holding means 3 can be adjusted through adjusting means 6.

Figure 2:
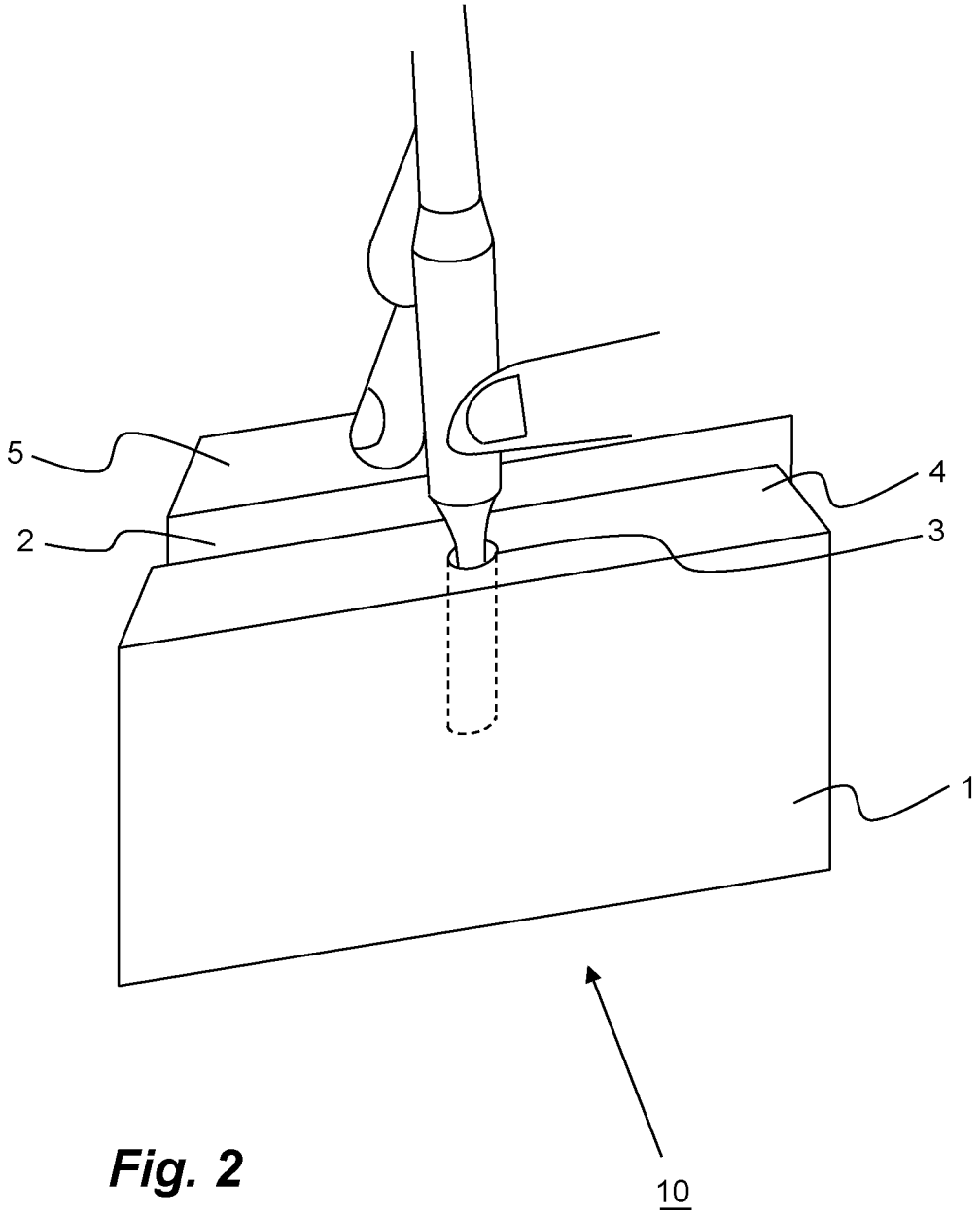
FIG. 2 is a view of the dart holder holding a dart which is grabbed at the barrel.

FIG. 2 shows the receiving of the tip of a dart in holding means 3 of first positioning means 1 whereby the barrel of the dart is being grabbed by positioning a hand and/or fingers on second landing area 5 of second positioning means 2. The plane of landing area 5 is arranged relative to the holding means 3 in such a way that it intersects the barrel, when located in the dart holder along the longitudinal axis of the dart.

Figure 3:
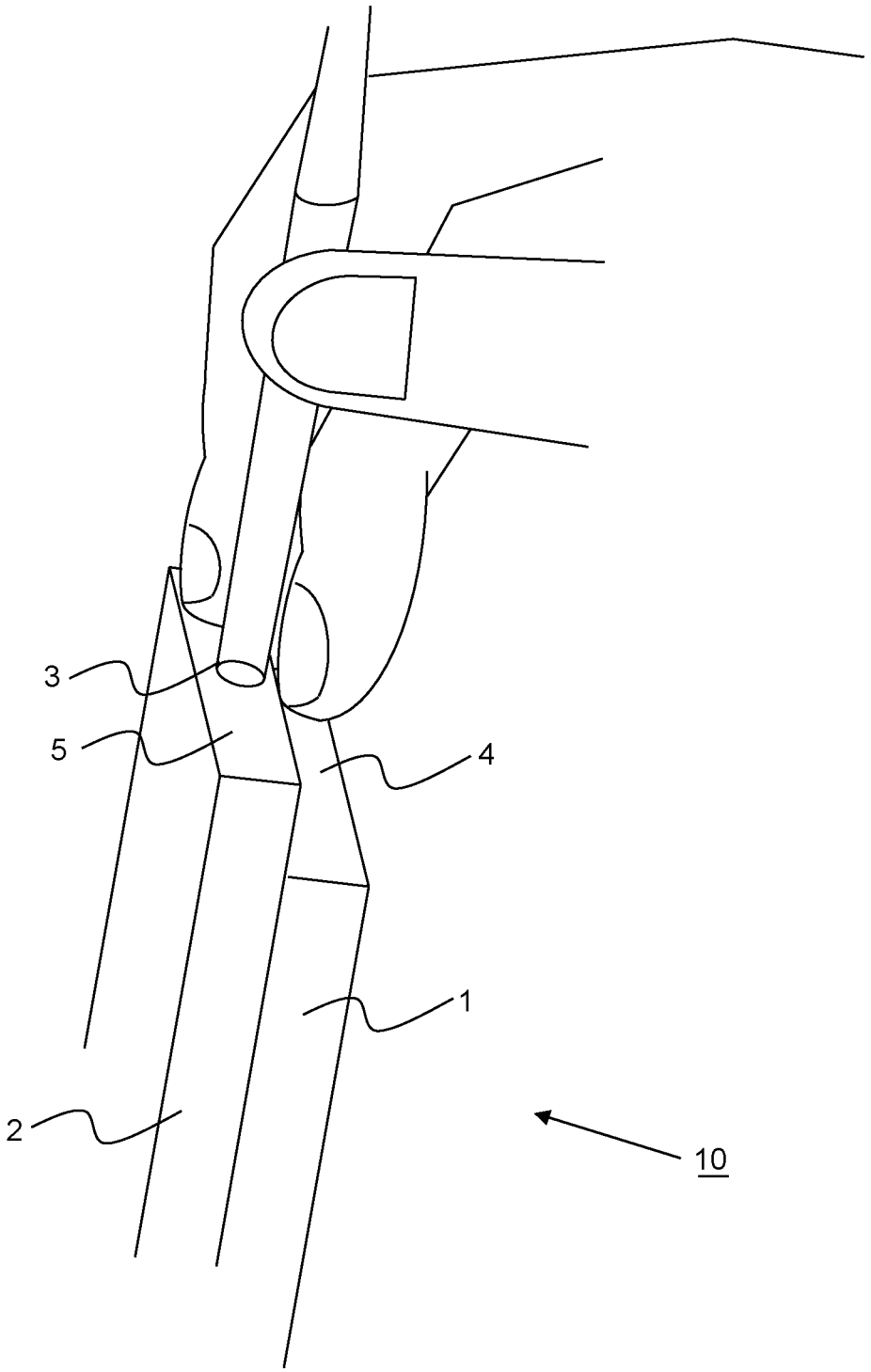
FIG. 3 is a view of the dart holder holding a dart which is grabbed by a hand in a pencil hold grip.

FIG. 3 shows the receiving of at least part of the tip and/or the barrel of a dart in holding means 3 of second positioning means 2 whereby the barrel of the dart is being grabbed by positioning a first finger on second landing area 5 of second positioning means 2 and a second finger and/or further finger on first landing area 4 on first positioning means 1. The plane of landing area 4 is arranged relative to the holding means 3 in such a way that it intersects the tip of the dart, when located in the dart holder along the longitudinal axis of the dart.

An angle formed by the longitudinal direction of holding means 3 is relative to a plane defined by first landing area 4 and/or second landing area 5 of positioning means 1 and/or positioning means 2 is in the range of 30° and 90° forming an acute angle. The acute angle facilitates that when the dart is taken from the dart holder the tip of the dart points upwards when held in throwing position.

Figure 4:
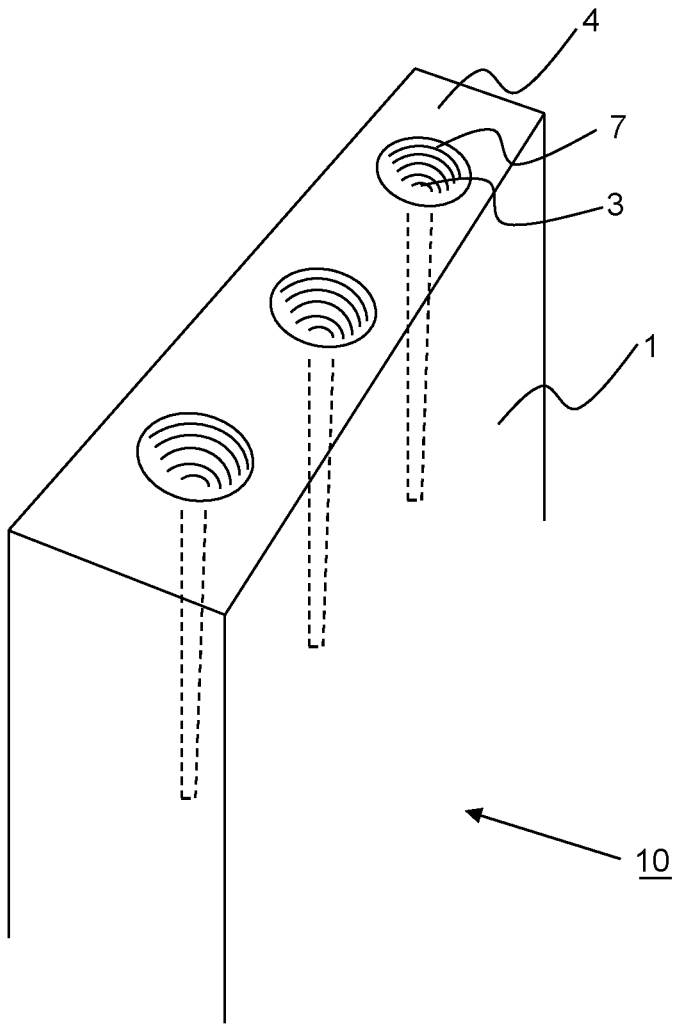
FIG. 4 is a view of the dart holder comprising a plurality of concave holes.

FIG. 4 shows the dart holder comprising concave cavity 7 situated between landing area 4 and holding means 3. The opening of holding means 3 is located between the plane of landing area 4 and the interior of first positioning means 1.

Figure 5A:
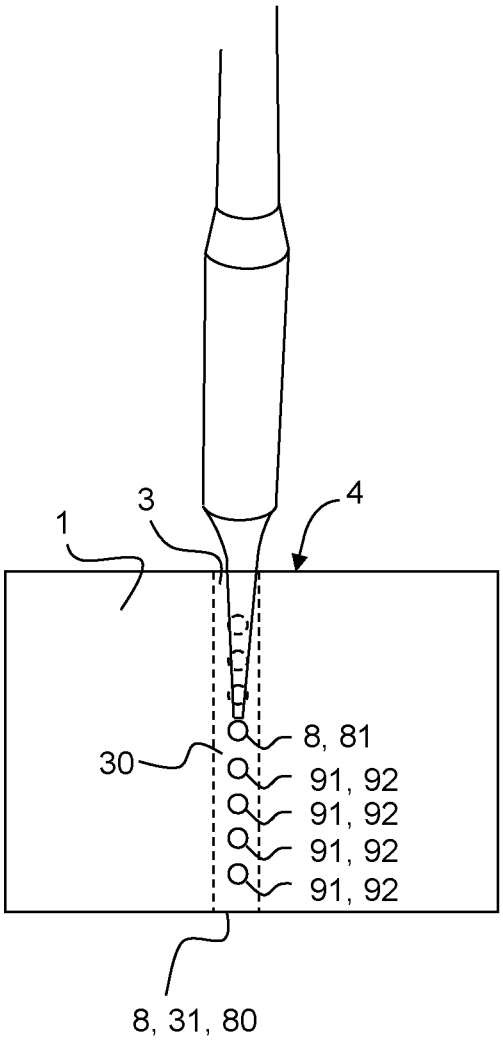
FIG. 5A is a front view of the first positioning means of the dart holder.
Figure 5B:
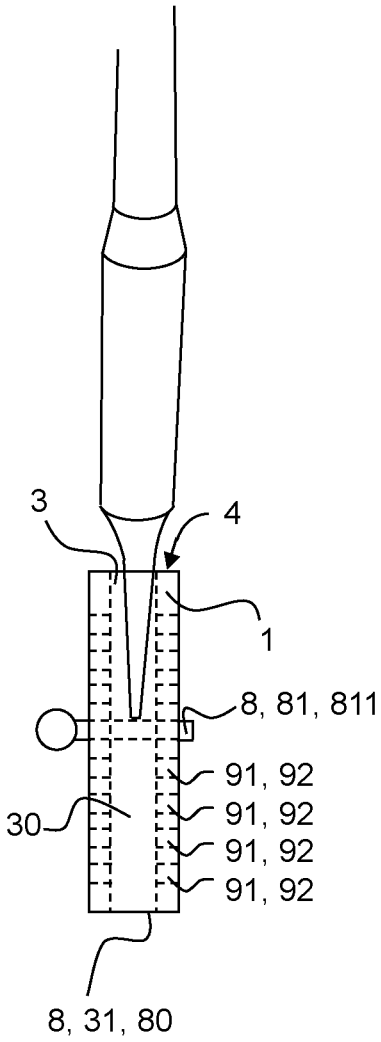
FIG. 5B is a side view of the dart holder according to FIG. 5A.

FIGS. 5A and 5B, as well as 6A and 6B, show a dart holder 10 according to the invention. The dart holder 10 comprises, per se, first positioning means 1; holding means 3 for holding optionally at least the tip and/or part of the barrel of a dart in a settled position in the first positioning means 1 such that the barrel of said dart is accessible for being grabbed by a user's hand; a first landing area 4 arranged on the first positioning means 1 in respect to the holding means 3 such that said first landing area 4 provides a reference to at least part of the hand for grabbing the barrel at a target position. According to the invention, the holding means 3 is formed by a shaft 30 extending from the first landing area 4 at least partially through the first positioning means 1 up to a shaft end 31 facing away from the first landing area 4, wherein the shaft 30 is provided with a limitation reference means 8 to define a limitation for the tip of the barrel when it is inserted in the shaft 30. The dart holder 10 according to the invention may optionally be used in a combination with the features described in FIG. 1-4 as well. The dart holder 10 comprising the features as described in FIG. 1-4 may, however, be provided independent from the features as described in FIGS. 5A, 5B, 6A, and 6B as well, i.e., last said dart holder 10 comprising:

- first positioning means 1;
- second positioning 2 means connectable to the first positioning means 1;
- holding means 3 for holding optionally at least the tip and/or part of the barrel of a dart in a settled position in at least one of the first and second positioning means 1 such that the barrel of said dart is accessible for being grabbed by a user's hand;

a first landing area 4 on the first positioning means 1 and a second landing area 5 on the second positioning means 2 arranged in respect to the holding means 3 such that said landing areas 4, 5 provide a reference to at least part of the hand for grabbing the barrel at a target position. Such a dart holder provides a reference to at least partly prevent a dart player from randomly grabbing the dart at any position on the barrel thus achieving higher accuracy in throwing the dart. Hereto the dart holder provides first and second positioning means that are connectable. The positioning means comprise holding means for holding the tip and/or part of the barrel of a dart in a settled position. In this way the tip and/or part of the barrel may be entered and withdrawn from the dart holder in a consistent and reproducible manner. When the tip of the dart is entered in the holding means, the barrel of the dart is accessible for being grabbed by a user's hand. The first positioning means comprise a first landing area and the second positioning means comprise a second landing area. In this way the landing areas provide a reference to at least part of the hand for grabbing the barrel of said dart at a target position when positioned in the holding means. Before grabbing the dart one or more fingers and/or part of the hand are placed on the landing area. In this way a reference for a grip position is provided.

Referring again to FIGS. 5A and 5B, these show the dart holder 10 according to the invention comprising first positioning means 1 including holding means 3 for holding optionally at least the tip and/or part of the barrel of a dart in a settled position in the first positioning means 1 such that the barrel of said dart is accessible for being grabbed by a user's hand. The first landing area 4 on the first positioning means 1 is arranged in respect to the holding means 3 such that said first landing area 4 provides a reference to at least part of the hand for grabbing the barrel at a target position. The holding means 3 is formed by a shaft 30 extending from the first landing area 4 at least partially through the first positioning means 1 up to a shaft end 31 facing away from the first landing area 4. The shaft 30 is provided with a limitation reference means 8 to define a limitation for the tip of the barrel when it is inserted in the shaft 30. In this way, the shaft 30 allowing the dart to travel into the positioning means 1, is provided with a limitation reference means 8 to restrict the tip of the dart from travelling beyond the limitation reference means 8 providing the dart may be inserted in a deepest position. When at least the tip and/or part of the barrel of a dart is inserted into the shaft 30, the deepest position of the dart is determined by the tip having arrived at the limitation reference means 8. The deepest position of the dart provides a reference point of the dart with respect to the landing area 4 of the first positioning means 1 so as to allow the user to grab the dart according to a predetermined position known by the user.

The limitation reference means 8 may be formed at the shaft end 31 by an opening 80 extending in the first positioning means 1. In this example, the shaft 30 forms a through hole. In use, the deepest position of the dart may be detected by means of holding a finger of the user at the shaft end side 31 of the first positioning means 1. When the user is sensing the tip of the dart at the opening 80 extending in the first positioning means 1 at the shaft end side 31 of it, the dart has reached its deepest position and such that the barrel of said dart is accessible for being grabbed by the user's hand according to a predetermined position with respect to the first positioning means 1.

The limitation reference means 8 may be formed by a stopper means 81 shown in FIGS. 5A and 5B. The deepest position of the dart is determined by the stopper means 81 preventing the dart or the tip of the dart from being inserted in the shaft 30 beyond the stopper means 81, such that the barrel of said dart is accessible for being grabbed by the user's hand according to a predetermined position with respect to the first positioning means 1. In this example, the stopper means 81 is adjustable along the longitudinal direction of the shaft. The relative position of the dart with respect of the landing area 4 of the first positioning means 1 may be adapted according to a dedicated position which is adapted and/or optimized for any specific user such that the barrel of said dart is accessible for being grabbed by said any user's hand.

Figure 6A:
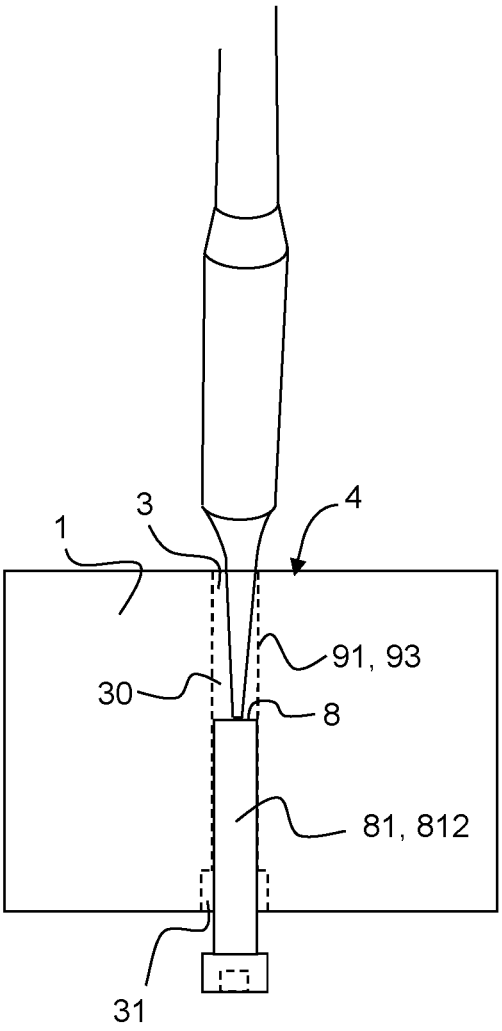
FIG. 6A is a front view of the first positioning means of the dart holder.
Figure 6B:
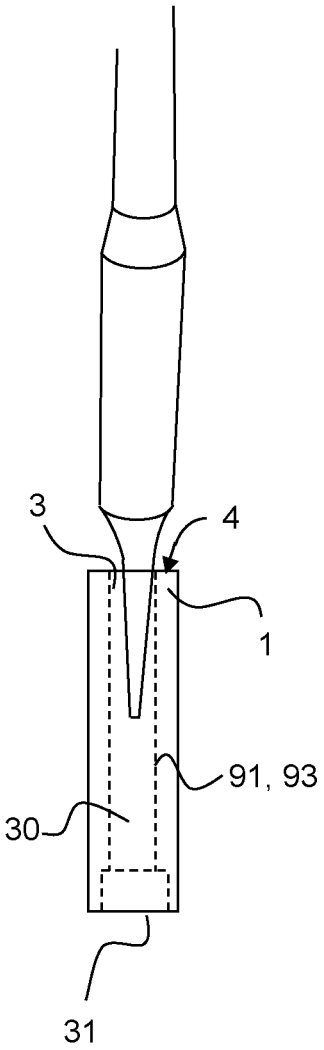
FIG. 6B is a side view of the dart holder according to FIG. 6A.

FIGS. 5A and 5B, as well as FIGS. 6A and 6B, show stopper adjustment means 91 arranged in the shaft 30 of the first positioning means 1. The stopper means 81 is arranged to cooperate with the stopper adjustment means 91. In this way it is possible to position the stopper means 81 relative to the shaft 30. The stopper adjustment means 91 present in the shaft 30 may be used to position the stopper means 81 relative to the shaft 30 so as to determine a position of the limitation reference means 8 preventing or restricting the tip of the dart from travelling beyond the limitation reference means 8 to cause a dedicated deepest position of the dart inserted in the shaft.

Referring to FIGS. 5A and 5B now, the dart holder 10 is shown wherein the stopper adjustment means 91 are formed by an array of staggered holes 92. Each hole 92 extends through the shaft 30 along a centerline transverse to the longitudinal direction of the shaft 30. In this example, the stopper means 81 are formed by a pin 811 capable of being arranged in at least one of the holes 92. The array of staggered holes provides to make a selection to apply the pin 811 to determine the location of the limitation reference means 8. As such, any specific user is provided to select a relative position of the dart with respect of the first landing area 4 of the first positioning means 1 which is a best fit for the specific user to grab the barrel at a preferred target position of said any specific user.

Referring to FIGS. 6A and 6B now, the dart holder 10 is shown wherein the stopper adjustment means 91 is formed by a thread 93 such as a screw thread. The stopper means 81 is formed by a bolt 812 such as a screw bolt, for example in the form of socket bolt shown in FIG. 6A. The bolt 812 is depicted in a state inserted in the shaft 30 to cooperate with the thread 93 of the stopper adjustment means 91. For purposes of clarity, the bolt 812 is not shown in FIG. 6B. The threaded shaft 30 provides any specific user to adjust and optimize a relative position of the dart with respect of the first landing area 4 of the first positioning means 1 according to a continuous variable adjustment, the adjusted and optimized relative position being a best fit for the specific user to grab the barrel at a preferred target position of said any specific user.

It should be noted that the above-mentioned embodiments illustrate rather than limit the invention, and that those skilled in the art will be able to design many alternative embodiments.

The invention claimed is:

1. A dart holder comprising:

first positioning means, holding means for holding at least the tip and/or part of the barrel of a dart in a settled position in the first positioning means such that the barrel of said dart is accessible for being grabbed by a user's hand, a first landing area arranged on the first positioning means in respect to the holding means such that said first landing area provides a reference to at least part of the hand for grabbing the barrel at a target position, wherein the holding means is formed by a shaft extending from the first landing area at least partially through the first positioning means up to a shaft end facing away from the first landing area, wherein the shaft is provided with a limitation reference means to define a limitation for the tip of the barrel when it is inserted in the shaft, wherein the limitation reference means is formed by a stopper means which is adjustable along the longitudinal direction of the shaft.

2. The dart holder according to claim 1, wherein the limitation reference means is formed at the shaft end by an opening extending in the first positioning means, the shaft thereby forming a through hole.

3. The dart holder according to claim 1, wherein stopper adjustment means are arranged in the shaft of the first positioning means and the stopper means is arranged to cooperate with the stopper adjustment means so as to allow to position the stopper means relative to the shaft.

4. The dart holder according to claim 3, wherein the stopper adjustment means are formed by an array of staggered holes, each hole extending through the shaft along a centerline transverse to the longitudinal direction of the shaft, wherein the stopper means are formed by a pin capable of being arranged in at least one of the holes.

5. The dart holder according to claim 3, wherein the stopper adjustment means is formed by a screw thread, wherein the stopper means is formed by a screw bolt, the bolt being arranged to cooperate with the screw thread of the stopper adjustment means.

6. The dart holder according to claim 1, comprising:

second positioning means connectable to the first positioning means;

a second landing area on the second positioning means arranged in respect to the holding means such that said first and second landing areas provide a reference to at least part of the hand for grabbing the barrel at a target position.

7. The dart holder according to claim 6, wherein the first landing area and the second landing area are staggered.

8. The dart holder according to claim 6, wherein the first landing area and the second landing area are configured to prevent a hand and/or one or more fingers from moving further along the barrel towards or in the direction of the tip of the dart when located in the dart holder.

9. The dart holder according to claim 6, wherein a plane defined by the second landing area is arranged relative to the holding means in such a way that it intersects the barrel of the dart when located in the dart holder.

10. The dart holder according to claim 6, wherein a plane defined by the first landing area is arranged relative to the holding means in such a way that it intersects the tip of the dart when located in the dart holder.

11. The dart holder according to claim 10, wherein the plane defined by the first landing area is located between a plane defined by the second landing area and the tip of the dart when located in the dart holder.

12. The dart holder according to claim 10, wherein a plane defined by the second landing area is located between the plane defined by the first landing area and the tip of the dart when located in the dart holder.

13. The dart holder according to claim 6, wherein the distance between the first landing area and the second landing area is adjustable.

14. The dart holder according to claim 13, wherein the dart holder comprises adjusting means for adjusting the distance between the first landing area and the second landing area according to his or her own preference to come to the best grip.

15. The dart holder according to claim 6, wherein the first landing area has a concave shape so as to allow a predefined grip on the dart based on the shape of the finger of the user.

16. The dart holder according to claim 13, wherein the first landing area has a concave cavity wherein the opening of the holding means is placed in a position underneath a plane defined by the first landing area as to provide a fixed reference position for grabbing the barrel of the dart when located in the holding means.

17. The dart holder according to claim 13, wherein the first landing area has a convex shape wherein the opening of the holding means is placed in a position above a plane defined by the first landing area as to provide a fixed reference position for grabbing the barrel of the dart when located in the holding means.

* * * * *